US006073792A

United States Patent [19]

Campbell et al.

[11] Patent Number: 6,073,792

[45] Date of Patent: Jun. 13, 2000

[54] ACCESS CAP

[76] Inventors: Lucky Campbell, 449 E. Topeka Dr., Phoenix, Ariz. 85024; Rodger Calder, 2611 S. 450 East, Bountiful, Utah 84010

[21] Appl. No.: 09/123,226

[22] Filed: Jul. 27, 1998

[51] Int. Cl.[7] ..... B65D 17/52

[52] U.S. Cl. ..... 220/284; 220/210; 220/260; 292/200; 292/202

[58] Field of Search ..... 220/284, 484, 220/3.8, 567.1, 567.2, 210, 262, 285, 260; 292/200, 202, 203, DIG. 2; 70/417, 423, 455, 54, 55, 56, DIG. 58

[56] References Cited

U.S. PATENT DOCUMENTS

| | | | |
|---|---|---|---|
| 1,902,731 | 3/1933 | Sherman | 220/210 |
| 2,038,462 | 4/1936 | Wellman | 292/202 |
| 3,930,388 | 1/1976 | Barras | 220/210 |
| 4,046,412 | 9/1977 | Lee | 292/200 |
| 4,118,962 | 10/1978 | Block et al. | 70/455 |
| 4,995,652 | 2/1991 | Mugnolo et al. | 292/202 |
| 5,520,300 | 5/1996 | Griffin | 220/210 |
| 5,582,443 | 12/1996 | Finkelstein et al. | 292/202 |
| 5,683,123 | 11/1997 | Ruoss | 292/202 |
| 5,845,800 | 12/1998 | Shaw et al. | 220/210 |

*Primary Examiner*—Stephen K. Cronin
*Attorney, Agent, or Firm*—Cahill, Sutton & Thomas P.L.C.

[57] ABSTRACT

A cap body has a movable retaining tongue which is engageable with a portion of an access structure to retain the cap on the structure. A tongue is manipulated through a bolt, the head of which is accessible at the top surface of the cap body. A cover for the bolt head has a locking post which extends through the cap body and engages and locks the tongue against movement.

6 Claims, 2 Drawing Sheets

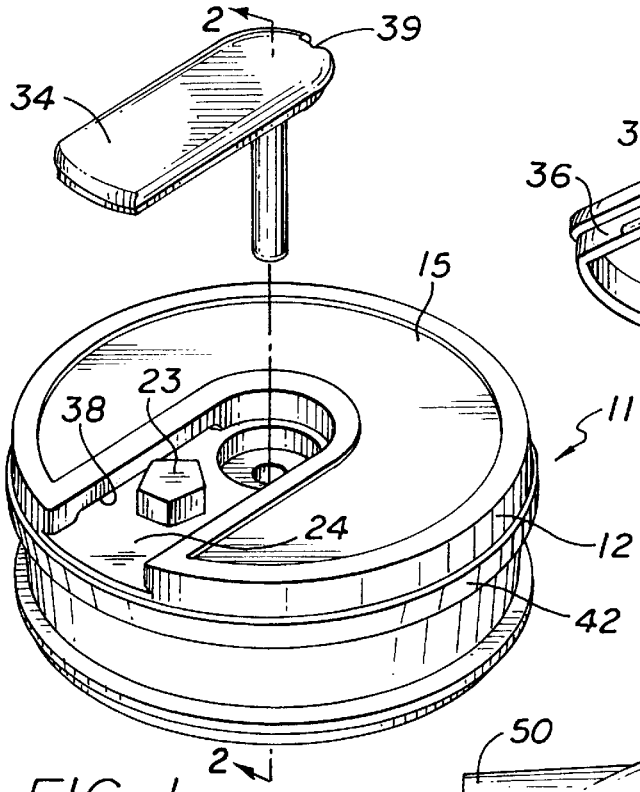
FIG. 1
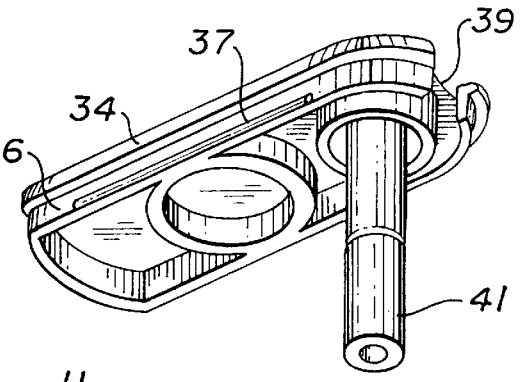
FIG. 7
FIG. 8
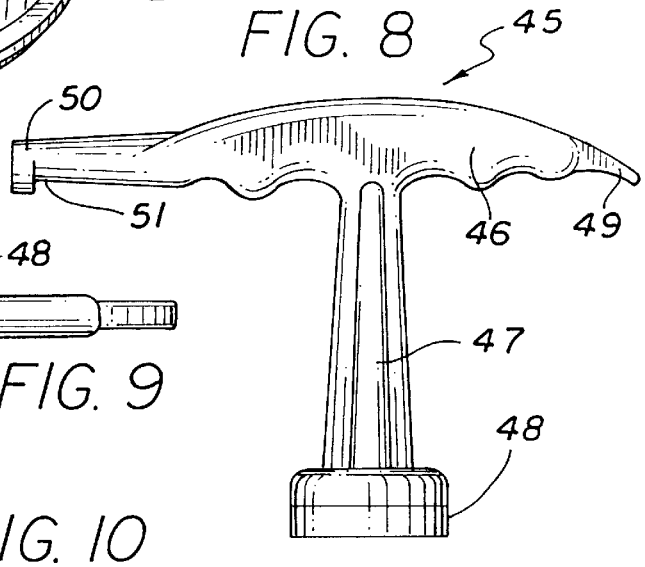
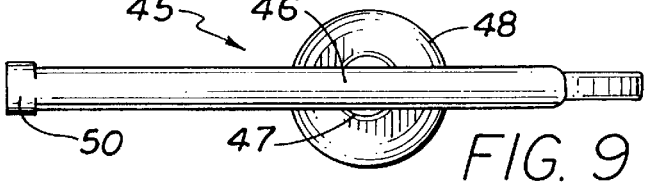
FIG. 9
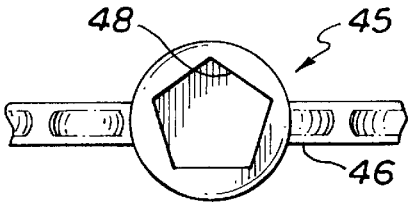
FIG. 10
FIG. 2
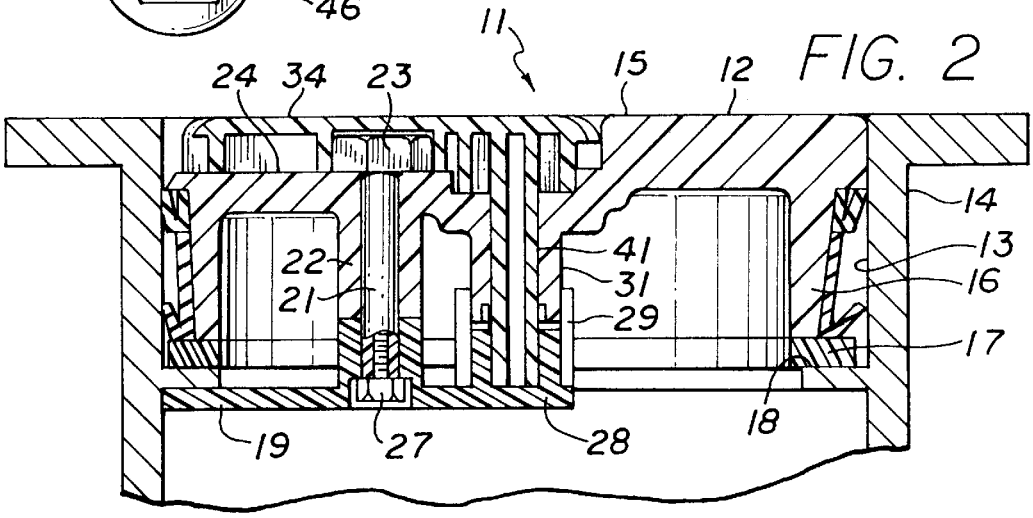

ACCESS CAP

TECHNICAL FIELD

This invention is concerned with providing a secure closure for an access opening.

BACKGROUND ART

It is customary in many municipalities to bury water and gas valves beneath the surface of the earth or roadway. Access to such a valve is provided through a pipe extending upwardly from the the valve to the surface. An access cap is employed to close the upper end of the pipe.

The access cap may rest loosely on the upper end of the pipe. But such caps are easily dislodged, leaving the pipe exposed to debris. For such installations, debris caps have been devised to be placed in the access pipe to keep the pipe from filing with debris.

Debris caps for this purpose are disclosed in the following U.S. Patents: U.S. Pat. No. 4,921,123, granted May 1, 1990, to G. J Mizock, and U.S. Pat. No. 5,439,130, granted Aug. 8, 1995, to G. C. Waugh.

The separate debris cap could be eliminated were the access cap designed in such a manner to be reliably retained in place on the access pipe.

U.S. Pat. No. 4,048,766, granted Sep. 20, 1977, to P. H. Dantzer et al. for "Closure Lid Assembly for Protective Housings" discloses a lid assembly in terms of a locking mechanism for the lid but discloses no details of construction.

DISCLOSURE OF THE INVENTION

This invention contemplates providing an access cap which includes a body configured to closely fill the entrance to the access pipe. A movable retainer tongue is positioned beneath the cap body and movable to a position in which it engages a portion of the pipe to prevent removal of the cap. The retainer tongue is manipulated by a member positioned in a recess in the upper surface of the cap body. A hand tool is provided to engage the manipulating member.

A cover member snaps in place on the cap body to cover and restrict access to the manipulating member. The cover member has a locking member thereon which extends through the cap body and engages and prevents movement of the retainer tongue when the cover is in place on the cap.

The cap may include a resilient flap extending around its perimeter to seal the connection between the cap and the access pipe.

BRIEF DESCRIPTION OF THE DRAWINGS

The invention is described in greater detail hereinafter by reference to the accompanying drawings wherein:

FIG. 1 is a perspective view of the access cap of the invention;

FIG. 2 is a vertical sectional view of the cap installed in an access pipe;

FIG. 7 is a perspective view of a cover member employed in the cap;

FIG. 8 is an elevational view of a tool useful for installing and removing the cap;

FIG. 9 is a top view of the tool; and

FIG. 10 is a bottom view of the tool.

BEST MODE FOR CARRYING OUT THE INVENTION

Figure 3:
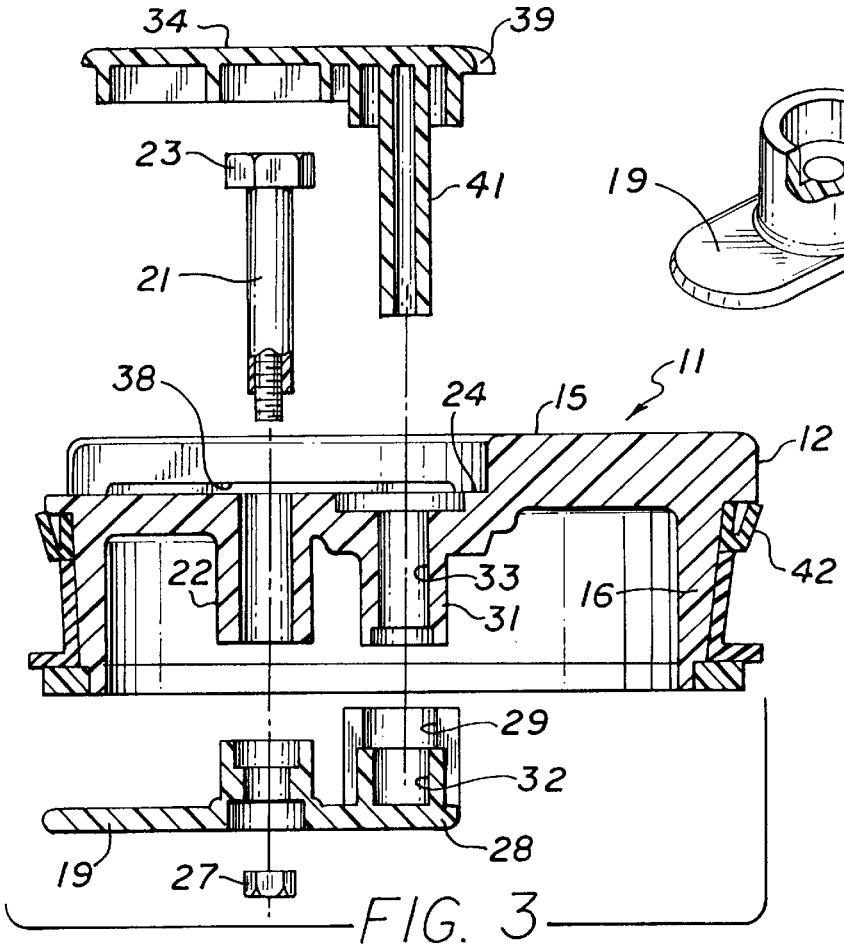
FIG. 3 is an exploded vertical sectional view of the cap.
Figure 5:
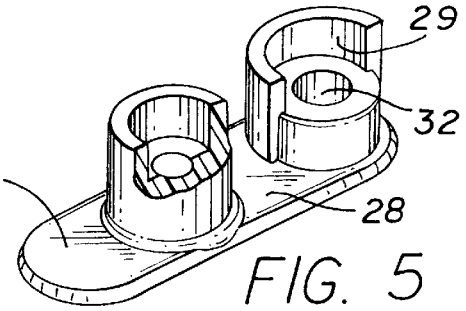
FIG. 5 is a perspective view of a retainer tongue employed in the cap.
Figure 6:
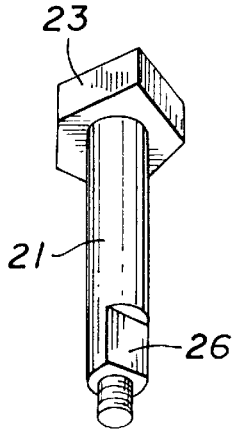
FIG. 6 is a perspective view of a tongue manipulating member employed in the cap.

The access cap of the invention is designated generally by reference numeral 11. The cap includes a generally cylindrical body 12 configured to close an opening 13 in the upper reaches of the access structure 14. In this instance, the access structure 14 is a cylindrical pipe with a circular opening. Hence, the cylindrical shape of the cap body 12. It is to be understood, however, that the cap 11 and the access structure 14 may have other configurations, for example, rectangular.

Cap body 12 has an upper surface 15, a depending cylindrical side wall 16, the lower edge of which has an annular ring 17 thereon which seats on an annular ledge 18 in the access structure 14.

In accordance with this invention, the cap 11 is retained in position within access structure 14 by a retainer tongue 19 which is movable to a position beneath the ledge 18. Tongue 19 is carried for swinging movement beneath cap body 12 by a bolt 21 extending downwardly through a sleeve 22 molded in the cap body 12. The upper end of bolt 21 possesses a pentagon-shaped head 23 disposed in a radially extending recess 24 in the upper surface of the cap body 12. Tongue 19 is secured to the non-circular lower end 26 of bolt 21 by means of a nut 27.

Figure 4:
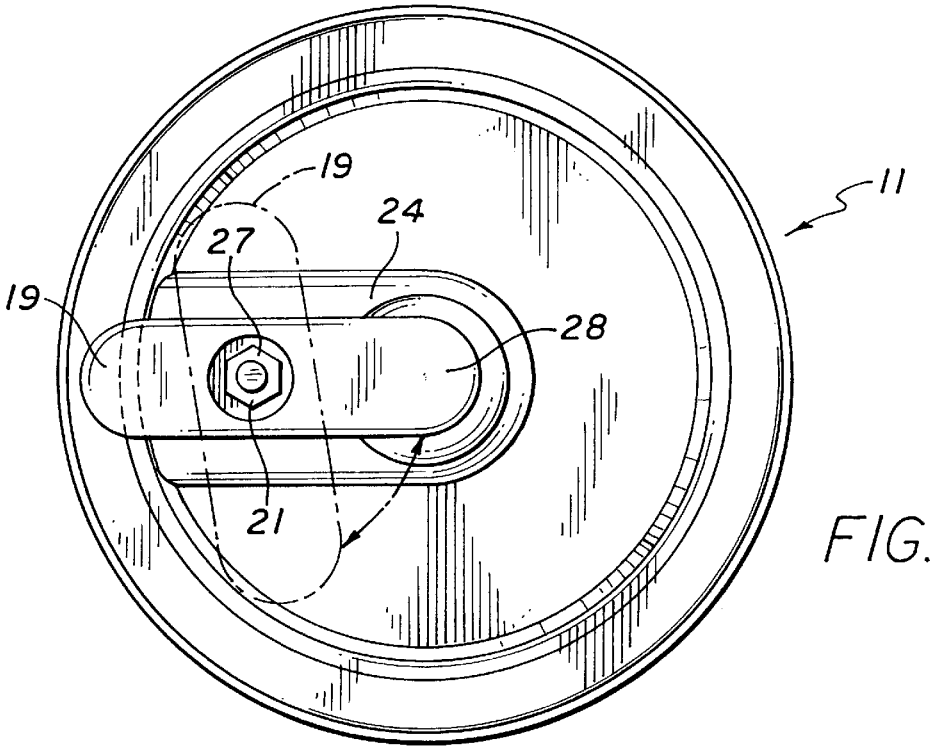
FIG. 4 is a bottom view of the cap.

Bolt 21 with its pentagon-shaped head 23 constitute means for manipulating retainer tongue 19. A tool engaging bolt head 23 can swing the tongue about the axis of the bolt 21 between two positions. In one position (solid lines in FIG. 4), the tongue extends beneath structure ledge 18 to retain the cap in the structure. In a second position (dot and dash lines in FIG. 4), the tongue 19 is clear of the ledge. With the tongue in the latter position, the cap 11 can be installed and removed from the access structure 14.

Tongue 19 has a reverse extension 28 which carries on its upper surface a semi-cylindrical stop 29 which is engagable with a hollow post 31 depending from cap body 12. Stop 29 engages post 31 when tongue 19 is moved to its retaining position beneath structure ledge 18. Stop 29 also has molded therein a cylindrical bore 32 which is aligned with the bore 33 in post 31.

To prevent unauthorized tampering with the bolt head 23, the cap 11 includes an elongated cover 34 shaped to snap into the radial recess 24 in the upper surface of the cap body 12. The elongated side edges 36 of cover 34 are preferably provided with slightly raised ribs 37 which are receivable in elongated grooves in the side walls of the recess 24. Cover 34 is molded of plastic material having sufficient resiliency to permit the cover to be snapped into place in the recess with the ribs 37 on the cover residing in the grooves 38 in the recess. But the material for cover 34 is sufficiently rigid to prevent the removal of the cover with the bare hand.

Persons authorized to remove an access cap 11 are provided with a tool which can be inserted beneath the slotted end 39 of the cover 34 to pop the cover free of the cap body 12.

The access cap 11 of this invention further includes a mechanism for preventing accidental, unintentional movement of retainer tongue 19 from its position for retaining cap 11 on structure 14. Such movement might be caused, for example, by vehicular traffic passing over the cap and causing it to rotate in the access structure. This mechanism includes a locking post 41 depending from cover 34. Post 41 is positioned such that when the cover 34 is snapped in place on cap body 12, the post is driven downwardly through the bore 33 in post 31 into bore 32 in tongue extension 28. Post 41 thus functions as a locking member, preventing movement of tongue 19. Removal of cover 34 obviously removes locking post 41 an permits manipulation of retainer tongue through bolt head 23 and bolt 21.

To insure a tight seal between the cap 11 and the access structure 14, the perimeter of the cap body 12 may be provided with a resilient annular flap structure 42.

FIGS. 8, 9 and 10 illustrate a multi-purpose hand-held tool 45 to be carried by personnel authorized to install and remove the access cap 11. The tool comprises a hand grip portion 46 and an extension 47 which carries a socket 48. Socket 48 has a pentagon configuration for cooperation with manipulating bolt head 23. A tapered tine 49 on one end of hand grip 46 is insertable beneath the slotted end 39 of cover 34 to pop the cover free of the cap body 12. Lastly, the opposite end of the hand grip 46 is provided with a cylindrical extension 50 which is notched at 51 a short distance from its distal end. The extension 50 of tool 45 is used to withdraw a cap 11 from the access structure 14. Extension 50 is inserted in the bore 33 of post 31 to a position in which notched region 51 can contact the lower edge of the post. Pulling upwardly on the tool 45 lifts the cap free.

What is claimed is:

1. A cap adapted to close an access opening in a structure, said cap comprising a body shaped to close the opening and having an upper and a lower surface, a retainer tongue pivotably carried beneath the lower surface of the body, means carried at the upper surface of the body and extending through the body for manipulating the retainer tongue, a cover member removably positioned on the upper surface of the body for covering the manipulating means, and a locking member carried by said cover member and extending through the body for engaging and locking the retainer tongue against movement when the cover member is in place on the body.

2. The cap of claim 1 wherein said manipulating means is shaped to be engaged by a tool.

3. The cap of claim 1, wherein said cover member is shaped to be engaged by a tool for removing the cover member.

4. The cap of claim 1, wherein said manipulating means is shaped to be engaged by a tool and said cover member is shaped to be engaged by a tool for removing the cover member.

5. The combination of the cap of claim 4 with a tool adapted to engage said manipulating means and said cover member.

6. The cap of claim 1, further comprising a resilient flap extending around the perimeter of the body for engagement with the structure.

* * * * *